US005681367A

United States Patent [19]

Hunter

[11] Patent Number: 5,681,367

[45] Date of Patent: Oct. 28, 1997

[54] METHOD OF PRODUCING HOT METAL

[75] Inventor: Phillip B. Hunter, Murrysville, Pa.

[73] Assignee: USX Engineers & Consultants, Inc., Pittsburgh, Pa.

[21] Appl. No.: 666,949

[22] Filed: Jun. 20, 1996

[51] Int. Cl.[6] ..... C21B 11/10

[52] U.S. Cl. ..... 75/10.48; 75/10.5; 75/10.58; 75/10.61; 75/10.63; 75/316; 75/317; 75/319; 75/484; 75/500; 75/771

[58] Field of Search ..... 75/10.48, 10.5, 75/10.58, 10.61, 10.63, 316, 317, 319, 484, 500, 771

[56] References Cited

U.S. PATENT DOCUMENTS 4,367,091 1/1983 Fujita et al. ..... 75/323

4,613,363 9/1986 Wienert ..... 75/10.62

5,601,631 2/1997 Rinker et al. ..... 75/484

FOREIGN PATENT DOCUMENTS 863689 9/1981 U.S.S.R. .

*Primary Examiner*—Melvyn Andrews

*Attorney, Agent, or Firm*—William L. Krayer

[57] ABSTRACT

A method for preparing iron bearing green pellets that can be processed in a rotary hearth furnace without degradation and become self-fluxing sponge iron pellets when charged to a submerged arc furnace operating at a lower temperature than the rotary hearth furnace, to produce hot metal having a carbon content from 1% to about 5%.

18 Claims, 3 Drawing Sheets

METHOD OF PRODUCING HOT METAL

TECHNICAL FIELD

This invention relates to a two-stage method of producing liquid iron containing carbon, known as pig iron or hot metal. The term pig iron is generally applied to a carbon bearing iron alloy that contains over 90 percent iron. In the liquid form the iron alloy is generally referred to as hot metal.

In the first stage of my invention, at least two different types of green pellets are reduced under reducing conditions such as in a rotary hearth furnace to make sponge iron, and in the second stage the sponge iron is further treated under smelting conditions such as in a submerged arc furnace. The compositions of the different types of green pellets are chosen so that the slag-forming components will not melt in the reducing step but the combination of the different types of pellets will melt to form a liquid slag in the smelting step.

BACKGROUND OF THE INVENTION

Steel producers are constantly seeking sources of low cost metallic iron that can be used to replace, if not all, at least a portion of the scrap used in the Basic Oxygen Furnace (BOF) and the Electric Arc Furnace (EAF). The need for a scrap substitute is particularly important where high quality, low residual content scrap is not available or is very expensive.

To supply these metallic iron units to the steel industry, a number of processes have been developed and are in production. These processes use a reductant, such as natural gas, coal, pitch, or other carbon-containing material, to chemically reduce the iron oxides in the ore to metallic iron. These reduction processes include steps such as grinding, mixing, adding a reductant and binder, pelletizing, and heating the green pellets to a temperature to accomplish the reduction, typically in a rotary hearth furnace (RHF) or similar equipment.

Rotary hearth furnaces are well known in the art. For the production of sponge iron, green pellets are placed perhaps three deep on a hearth which is caused to rotate to expose the pellets to high temperatures for a time sufficient for more than 80% of the $Fe_2O_3$ to be converted to metallic iron; residence times at temperatures over 1400° F. may vary from 10 to 20 minutes.

The final product after reduction, generic sponge iron (SI), contains metallic iron, a small amount of partially reduced iron oxide, carbon, and gangue material, such as $Al_2O_3$, CaO, MgO, $SiO_2$, etc. If the SI is charged to either a BOF or an EAF process, the composition of the gangue content of the SI is of little consequence because of the turbulent mixing of the SI with the native slag and hot metal phases during refining, and the high process temperatures of these two processes. If, however, the SI is charged to a submerged arc furnace (SAF) to produce a hot metal with a carbon content that could range from 1 to 5 percent, then the composition of the gangue material present in the SI does become critical, because the SI slag components are the only slag components present and therefore will form the final slag phase. The composition of this final slag phase is critical because the operating temperature of a SAF is substantially less than either the BOF or the EAF processes. Consequently, the slag phase in the SAF process must have a low melting temperature and be molten and fluid enough to drain from the SAF at the lower operating temperature of the SAF.

A submerged arc furnace (SAF) is a hybrid of two processes—a blast furnace bottom and an electric arc furnace top. In the operation of the SAF, sponge iron is fed continuously from the top into the SAF while electrical power is delivered continuously through electrodes. The electrical energy completes the reduction of the iron oxides and supplies the energy to liquify the hot metal. The sponge iron fed to the SAF contains sufficient carbon to complete the reduction of the remaining iron oxides in the sponge iron, and to alloy the hot metal to the desired carbon content.

As the sponge iron melts, a pool of liquid hot metal builds on the hearth, and molten slag resides on top of the hot metal. The temperature of the hot metal will depend on the carbon content of the hot metal but in general will be in the range of 1400° to 1500° C. (2550° to 2730° F.). Because the cooler sponge iron pellets, at 500°–900° C. (930°–1650° F.), will be fed continuously onto the top of the slag, the temperature of the slag is generally somewhat cooler than the hot metal pool.

Periodically a portion of the liquid hot metal pool is tapped into a ladle and the tap hole is closed with suitable equipment such as a mud gun. In a similar fashion as the slag layer on the molten hot metal pool increases in depth, a portion of the slag is drained from the SAF and the slag tap hole is closed.

Because slag must be drained from the SAF at periodic intervals, it is necessary that the slag be fluid at a temperature below that of the hot metal. The lower the melting point of the slag and hence the greater the temperature differential between the melting point of the slag and the operating temperature of the SAF (temperature of the hot metal), the more fluid the slag, and the easier it is to drain the slag.

It is known that a low melting point slag can be obtained in the SAF by combining appropriate amounts of finely ground bauxite ($Al_2O_3$), calcitic lime (CaO), dolomitic lime (CaO/MgO), and sand ($SiO_2$), with the iron ore, reductant and binder, each known to contain gangue materials (non-iron compounds such as $Al_2O_3$, CaO, MgO, $SiO_2$), prior to forming the green pellets that are used in the Rotary Hearth Furnace (RHF) to form sponge iron.

The concept and methods for adding slag-forming materials to iron ore to produce a self-fluxing cold charge material that is suitable for use in a blast furnace are well understood and widely practiced. But the concept of a traditional self-fluxing pellet that would produce a low melting temperature slag cannot be applied directly when the green pellet must first (prior to use in the SAF) be exposed to the high temperatures necessary to perform the reduction step described earlier, typically in a rotary hearth furnace.

When a rotary hearth furnace is used to convert the green pellets to SI, the temperature in the reduction zone of the furnace can be 1400° C. (2550° F.) and higher, and may exceed the melting point of a purposefully blended, low melting point, slag even when operated at somewhat lower temperatures, i.e. 1250°–1350° C.

If a single self-fluxing pellet, designed with a slag composition suitable for use in a SAF, is used in a RHF that is operated at the highest operating temperature to maximize reduction of the iron oxide, the designed slag would liquify, causing the pellets to stick to each other and also the hearth of the RHF. This premature formation of a fluid slag would cause significant operating problems and productivity losses. If the RHF is operated at a lower temperature to avoid formation of a fluid slag, the amount of iron ore reduction would decrease, resulting in less metallic iron in the SI and transferring an unnecessary portion of the reduction to the SAF, at higher costs and with a loss of productivity.

If one were to charge green pellets formed using only iron ore, reductant and binder to the RHF, and attempt to adjust the slag-forming composition in the SAF by adding appropriate materials to the SAF to form a lower-melting eutectic slag, one would find the task extremely difficult, because the relatively small amounts of materials in finely ground form would have to be distributed uniformly in the SAF and penetrate the layer of unreacted pellets to reach the slag/hot metal interface for combination with the other gangue/slag constituents. Given the relatively quiescent nature of the SAF and the lack of mixing of slag and hot metal as occurs in the EAF and BOF processes, the uniform distribution of small amounts of several different fluxes would have to be accomplished with complex equipment being required for feeding each material through multiple ports at multiple locations, in the presence of large electrodes. The ability to achieve this uniform distribution would be unpredictable given the complexity of the addition and the presence of CO gas streams generated by the reduction process which would likely entrain and carry away a portion of the added fluxes with the exhaust gases.

This invention provides a method that permits the use of pellets which are self-fluxing in a SAF while avoiding the formation of a liquid slag when the green pellets are first processed in a high temperature reducing environment such as in a RHF to form SI.

SUMMARY OF THE INVENTION

This invention provides for the use, in a submerged arc furnace (SAF) or other smelting means (hereafter sometimes called a smelting zone), of self-fluxing SI pellets which have been reduced at temperatures higher than the temperature of the liquid slag in the smelting zone. A combination of fluxing or gangue components, including binders, is chosen to have a relatively low melting point for slag-forming in the SAF. The fluxing or gangue components are divided into at least two different compositions for pellet formation, each composition having slag-forming components with melting points higher than the temperature which will be achieved in the reducing step so that no melting takes place in the RHF or other initial reducing step. The green pellets are reduced to SI, which is fed to the SAF under conditions assuring mixing of the slag-forming components from the (at least) two types of pellets to achieve the aforementioned combined composition having a relatively low melting temperature.

In a preferred form of my invention, two streams of pellet ingredients are blended for pelletizing more or less conventionally. Each stream of the major ingredients iron ore and coal or other carbonaceous reductant (in an appropriate ratio for reduction as is known in the art) is mixed with selected portions of the total additional fluxing agents and/or other slag-forming agents required to form a low melting point slag in the smelting zone. The amounts of the fluxing agents to be mixed with each ore/reductant stream are chosen, taking into account also the ingredients of the binder and other gangue components present in the ore and reductant, to result in gangue compositions that are non-melting at the temperature in the reducing zone, preferably a RHF. Ideally, each stream has its own pelletizer and the process is continuous.

The two (or more) streams of green pellets are preferably combined on or before entering a single RHF, or, if there are two (or more) RHFs, each stream may have a dedicated RHF with the streams of SI pellets preferably being mixed before being transported to the SAF.

As the mixture of the two (or more) kinds of SI pellets is fed continuously into the SAF, and descends through the slag, the pellets increase in temperature. Eventually the pellets reach the high temperature of the smelting zone where reduction of the iron oxides is completed, with the metallic iron and excess carbon entering the molten hot metal pool, releasing the finely ground slag components contained in the SI pellets in close proximity to one another, to form the desired low-melting point eutectic slag.

Persons skilled in the art will realize that the key to my invention is the selection of two or more different combinations of slag-forming components for the different streams of green pellets. The two or more different compositions must each withstand the temperatures of the initial reducing process without melting, but melt when combined in the SAF or other smelting zone under lower temperature conditions. Components of the slag-forming compositions include the binding agent ingredients, as will be seen in the more detailed description below.

By placing the fluxing agents directly in the pellets in a way that assures they will not melt in the reducing step, my invention avoids the complications inherent in adding them separately to the slag layer in the submerged arc furnace or other smelting zone.

In a preferred form of my invention, the ratios and amounts of slag-forming components chosen for the two or more types of green pellets are selected to minimize the total amount of slag to be made in the SAF, while at the same time adhering to the above-stated principle, that the green pellets must not form liquid slag in the relatively high temperatures of the RHF but when blended together melt to form a fluid slag in the relatively low temperatures of the smelting zone. As will be seen below, the objective of minimizing total slag can lead to the manufacture of types of green pellets having noticeably different compositions.

In another aspect of my invention, the melting points of the slag-forming components of the separate green pellets are kept at temperatures at least 100° C. higher than the eutectic melting point of the combined slag-forming components, and the reducing and smelting zones are operated at temperatures so that no melting takes place in the direct reduction, but does in the smelting step.

Persons skilled in the art will recognize that my invention may be used to make hot metal containing a full range of carbon, i.e. from about 1% carbon to about 5%. In the case of hot metal saturated with carbon, the SAF hearth will usually be made of carbon; where lower carbon contents are desired (lower than saturated), other refractory materials will be used for the lining and hearth, generally having a high magnesia content. Where a magnesia lining is used, the practitioner may increase the magnesium oxide (MgO) content of the slag-forming materials so that they include 1–8% MgO (with carbon in the hot metal up to 5%). Dolomitic lime is a common source of magnesia and one should of course take into account both the MgO and the CaO contents of the dolomitic lime when calculating the melting temperatures of the two or more types of green pellets and the overall slag-forming composition in the SAF.

BRIEF DESCRIPTION OF THE DRAWINGS

The invention will be explained further partly in reference to the attached drawings, in which.

DETAILED DESCRIPTION OF THE INVENTION

Figure 1:
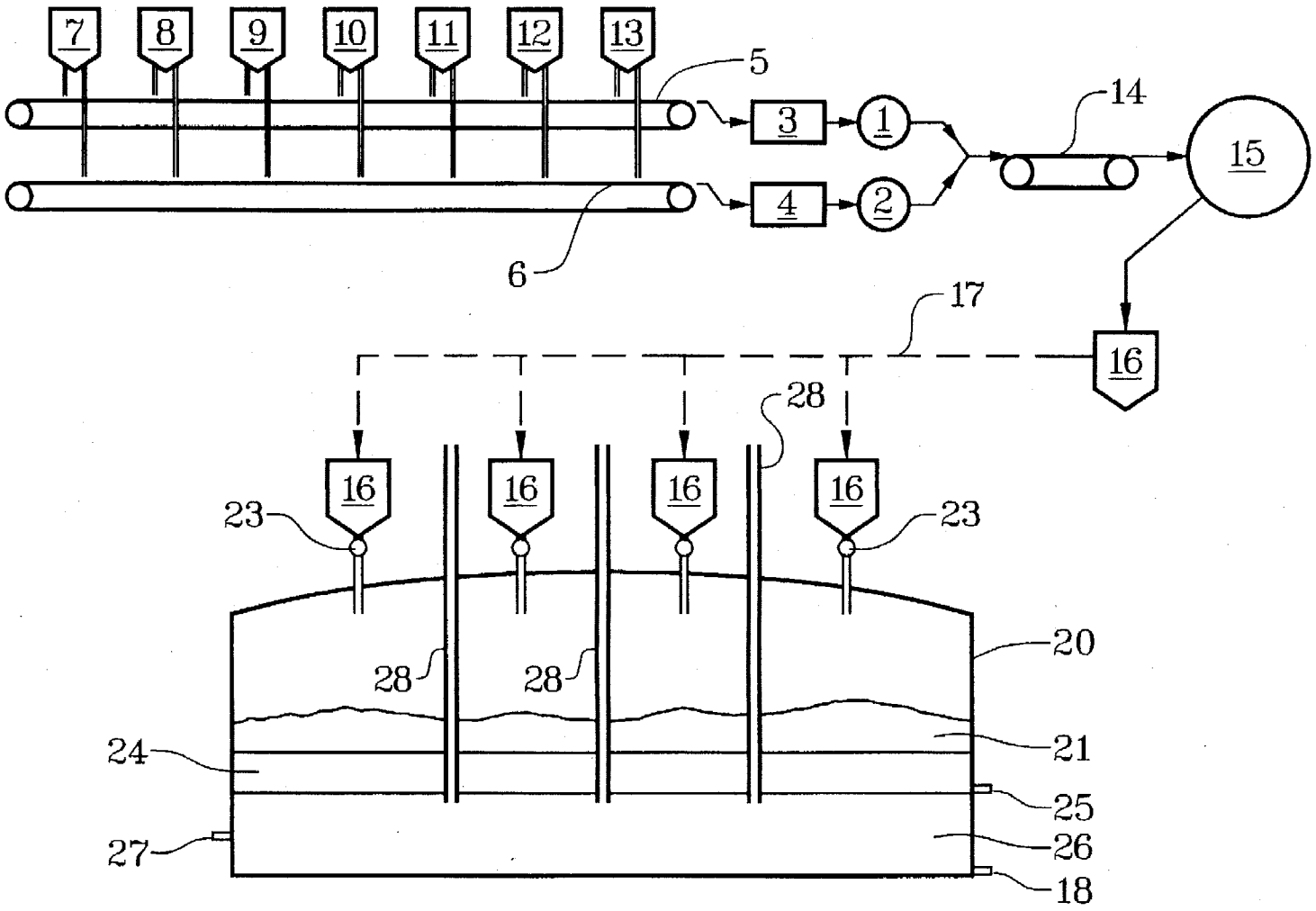
FIG. 1 is a process flow sheet showing the manufacture of two types of pellets, feeding of the pellets to a rotary hearth furnace to form sponge iron, and feeding of the sponge iron to a submerged arc furnace to form hot metal.

Referring now to FIG. 1, the preferred mode employs two conventional pelletizers 1 and 2 operating in parallel to make streams of green pellets of two different compositions. The particular makeup of the compositions will be described in more detail below, but generally it will be understood that dispensers for powdered coal 7, ground iron ore 8, sand 9, dolomite 10, calcitic lime 11, binder (bentonits) 12, bauxite 13, located above two separate ingredient conveyors 5 and 6, are controlled to dispense their respective pellet components previously ground and/or sized for conventional pellet making, in predetermined amounts and ratios. The materials are continuously fed into separate mixers 3 and 4 before being pelletized in a known manner in separate pelletizers 1 and 2. After pelletizing they are delivered continuously in a controlled ratio to pellet conveyor 14 which places the pellets in a rotary hearth furnace 15 for reduction of the ore. Generally the RHF treatment will be at 1300° to 1500° C. (2375° to 2730° F.) for a duration of ten to twenty minutes. Any direct reduction process (one including fixed carbon in pellets) using temperatures of the ranges described herein may be used instead of a rotary hearth furnace. The produced sponge iron (SI), still in the form of pellets, is placed in insulated transfer containers 16 and sealed to preserve heat and minimize reoxidation. The insulated transfer containers 16 are then moved, usually one by one, by transfer means 17 to positions above SAF 20. Port controls 23 are programmed to feed the mixed pellets from the insulated transfer containers 16 into the SAF 20 at different locations for different times to minimize melting difficulties. The pellets drop onto previously fed pellets in reaction zone 21, where they sink through gradually increasing temperature zones, as will be illustrated in more detail in FIG. 3. As they reach the higher temperatures near the slag layer 24, which is in the range of 1400°–1500° C. (2552°–2732° F.), a mixture or solution of iron and carbon melts within the pellets, and slag-forming materials are freed from both kinds of pellets, forming the eutectic composition necessary to melt. Reduced metal, together with the desired amount of carbon, sinks to the liquid metal layer 26.

The mixture of the two kinds of reduced pellets (sponge iron) is fed continuously to the submerged arc furnace 20. There may be as many as four or more insulated transfer containers 16 situated on the SAF at one time. Not all the containers 16 necessarily feed pellets at the same time. The containers 16 are desirably located around the perimeter of the furnace with feeding occurring from several contiguous containers 16 while empty containers 16 may be removed and replaced with full containers 16 at their respective ports. One container 16 may be located to feed pellets in the center of the SAF. The slag layer 24 is generally maintained by electrodes 28 at a temperature of 1400° to 1500° C. Slag is removed periodically through slag tap hole 25. Hot metal 26, typically at a temperature of 1400° C. to 1500° C., is removed periodically through liquid metal tap hole 27 in a conventional manner. A second liquid metal tap hole 18 at a lower elevation provides for complete drainage when necessary.

It will be understood that, in order to assure that the correct quantities and proportions of the proper fluxing agents are distributed with adequate uniformity in the slag layer 24, the two or more streams of pellets are preferably pre-blended as on conveyor 14 or otherwise upstream of the rotary hearth furnace 15 so that the slag-forming agents are present and thoroughly mixed in the correct amounts and proportions for forming a molten slag in the submerged arc furnace.

Figure 2:
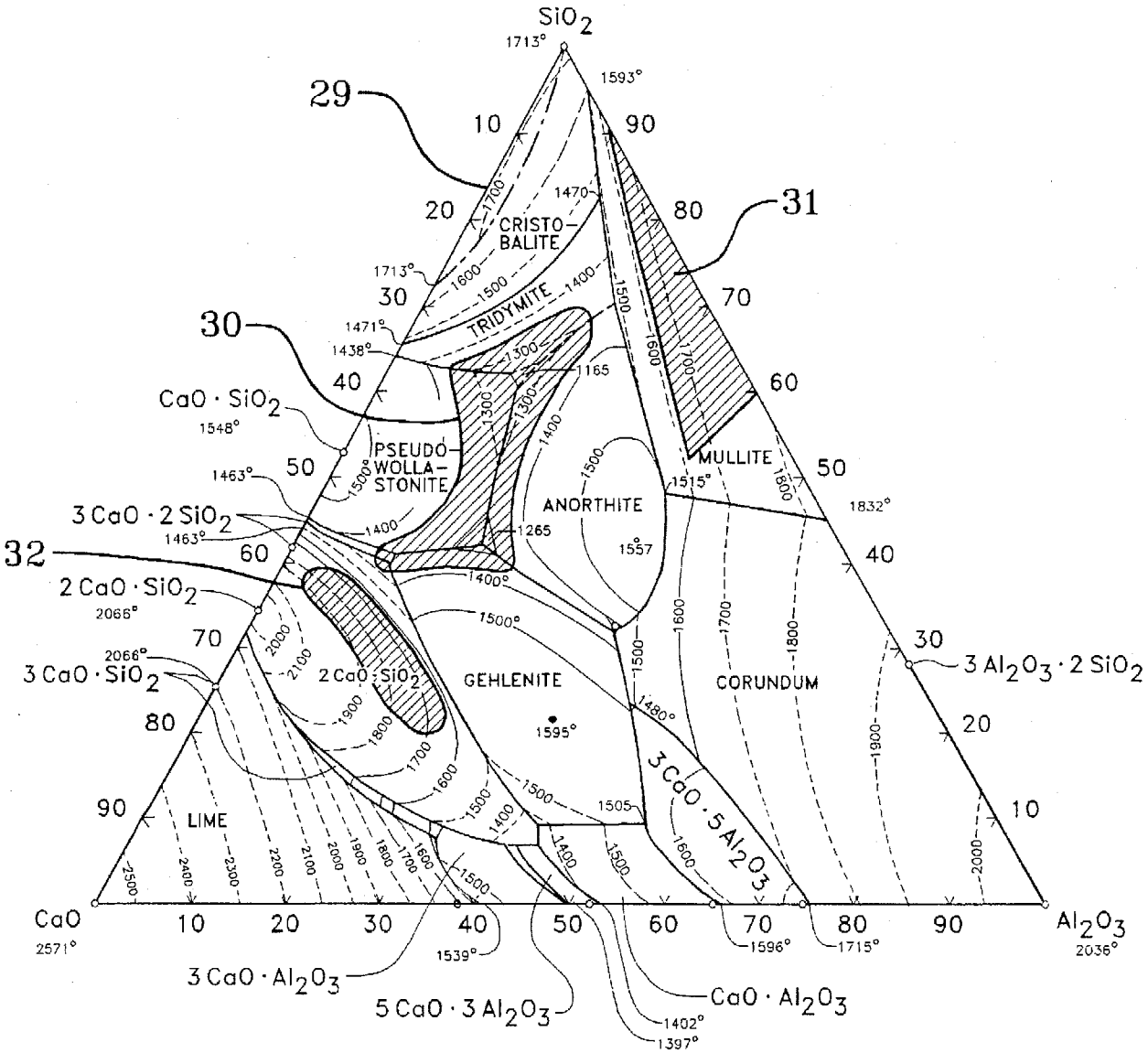
FIG. 2 is a phase diagram showing two areas representing two preferred compositions as fluxing or slag-forming materials for use in making green pellets, and a third area representing a composite of the two preferred compositions.

Referring now to FIG. 2, the triangular phase diagram 29 of common slag-forming components is known and in fact the basic phase diagram 29 is reproduced from "The Making Shaping and Treating of Steel" by United States Steel Corporation. The ordinates are in terms of percentages by weight of CaO, $SiO_2$, and $Al_2O_3$. The isotherms represent melting points in degrees Celsius. Superimposed on the prior art phase diagram are regions 30, 31, and 32, representing areas of the phase diagram of particular importance in the preferred version of my invention illustrated herein. Region 30 represents combinations of $CaO/SiO_2/Al_2O_3$ having melting temperatures suitable for melting in the SAF to form slag. Specifically, the perimeter of Region 30 is drawn on an isotherm of 1375° C. and includes compositions having the lowest eutectic melting temperatures in the phase diagram 29. Regions 31 and 32 represent combinations of $CaO/SiO_2/Al_2O_3$ which will not melt in the higher temperatures of the RHF—that is, Regions 31 and 32 represent compositions having melting points of at least 1600° C. Appropriate amounts of material from regions 31 and 32 chosen according to my invention and mixed together with slag-forming materials from the ore, coal and binder will satisfy the requirements of region 30, i.e. the combination will melt in the lower temperature smelting zone of the SAF. As will be seen below, the amounts do not have to be equal; various ratios of materials from regions 31 and 32 can make up compositions of Region 30.

Preferred compositions providing a slag having a melting temperature within the area of region 30 in FIG. 2 have the following components:

Preferred Region 30 Compositions

| | RANGE, % | AIM, % |
|---|---|---|
| $SiO_2$ | 45 to 65 | 53 ± 5 |
| $Al_2O_3$ | 10 to 20 | 15 ± 3 |
| CaO | 20 to 40 | 32 ± 4 |

Regions 31 and 32 in FIG. 2 define two different ranges of compositions having melting points of at least 1600° C. which, when combined, will provide Region 30 compositions. Preferred Region 31 and 32 compositions are:

| | Region 31 | | | Region 32 | |
|---|---|---|---|---|---|
| | RANGE % | AIM % | | RANGE % | AIM % |
| $SiO_2$ | 60 to 80 | 73 | $SiO_2$ | 20 to 40 | 30 |
| $Al_2O_3$ | 20 to 30 | 25 | $Al_2O_3$ | 5 to 15 | 10 |
| CaO | 0 to 5 | 2 | CaO | 50 to 70 | 60 |

The practitioner will realize that, for many combinations of reducing and smelting zones, it will be possible to utilize combinations of pellets having slag-forming points less than 1600° C., and the use of such pellets, for example having slag melting points of at least 1550° C., is contemplated in my invention; such compositions may be outside Regions 31 and 32.

Bentonite is a preferred binder for both Region 31 and Region 32 compositions. The bentonite is usually in the range of 2% to 5% of the total weight of all the materials in each separate stream, to perform its function as a binder. A commercially available bentonite composition comprising 3.17% Fe, 58.3% $SiO_2$, 1.25% CaO, 1.73% MgO, 19.74% $Al_2O_3$, and 0.19% S, with a LOI of 14.26% is preferred because of its relatively low silica content; in any event, the composition of the bentonite should be taken into account as providing slag-forming components to the pellets in the system. Likewise, dolomite, which will be used where the product is to have a low carbon content, as mentioned above, provides a significant source of magnesium oxide, typically in a ratio of CaO/MgO of about 60/40; this, too must be taken into account when calculating the melting points of the slag-forming components both in the individual pellets and in the overall slag composition of the SAF. As will be seen below, the amounts of slag-forming components of the ore and coal are of course even more significant than those of the binder, calcitic lime and dolomite.

Figure 3:
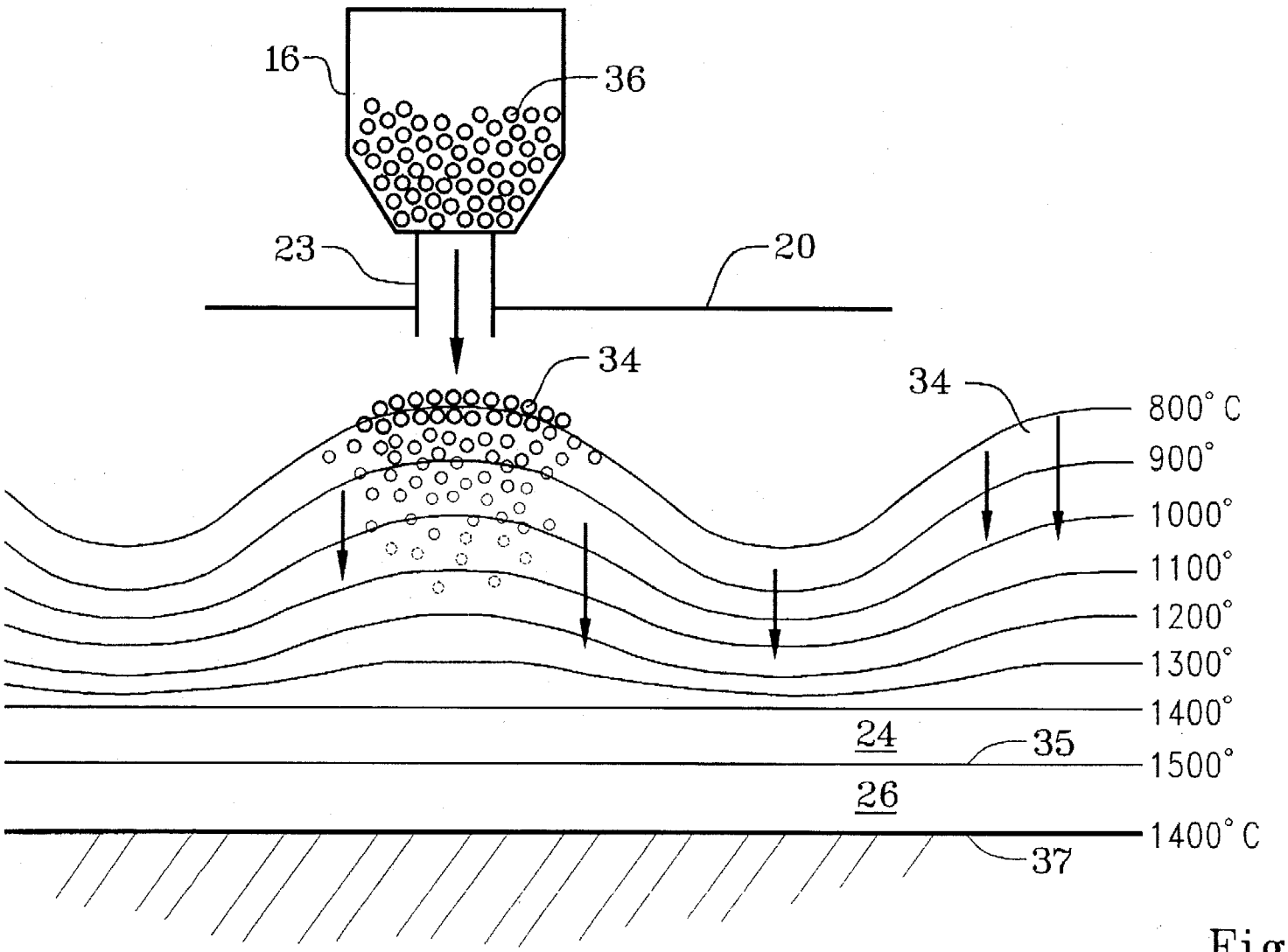
FIG. 3 is a schematic of the passage of sponge iron (SI) pellets through the reaction and slag layers of the SAF.

Referring now to FIG. 3, an insulated transfer container 16 is seen to be positioned over the submerged arc furnace (SAF) 20. As the sponge iron pellets 36 are fed through feed port 23 into the SAF, they fall onto and roll down piles 34 of previously fed SI pellets 36. The several piles (below each feed port 23) Of SI continue to settle as the lower layers of the piles 34 of SI sink into molten slag layer 24. Here there is sufficient temperature to complete the reduction of the partly reduced iron oxides. As the metallic content of the SI increases, the SI continues to descend to the slag/hot metal interface 35 where the metallic iron and the excess carbon join the liquid metal phase, leaving the slag components to join the slag phase. The molten slag layer 24 is generally maintained at a temperature of 1300° to 1500° C., preferably between 1350° and 1450° C., or, as shown, at least 1400°, reaching 1500° C. at interface 35. FIG. 3 shows isotherms at intervals of 100 degrees, specifically at 800°, 900°, 1000°, 1100°, 1200°, 1300°, and 1400° C. to show the increasing temperatures encountered by the sinking sponge iron pellets. The heat energy is applied by the electrodes 28 (see FIG. 1) primarily to the liquid slag and metal layers 24 and 26.

My invention is of course not limited to the use of compositions of Regions 31 and 32 to make a slag-forming composition of Region 30 of FIG. 2, nor is it limited to the use of only two pellet forming compositions, nor to the particular compositions described herein, nor do they have to be used in equal amounts. The general concept is to decide upon a low-melting slag-forming composition for the submerged arc furnace, and select combinations of its ingredients which will not melt in the rotary hearth furnace, placing those combinations in two or more types of pellets. The practitioner will recognize that the composition and amount of the binder to be used for making the pellets will enter into the calculations, and also the slag-forming components of the ore, the reductant, and other additions. The invention is of course also not limited to the use of the materials in the FIG. 2 $CaO/SiO_2/Al_2O_3$ phase diagram, but can include other common slag materials such as MgO, and can anticipate that FeO may become a slag component. With higher MgO contents, i.e. up to 8%, hearth 37 may be made of MgO rather than the usual carbon. If the SAF is operated at temperatures higher than contemplated herein, then the overall slag may have a higher melting point, for example 1400° C. or higher. As indicated earlier, other reducing and smelting means may replace the rotary hearth furnace and the submerged arc furnace so long as they are operated at the temperatures indicated herein and/or with at least 100° C. between them.

Persons skilled in the art will appreciate that one will not want to use any more slag-forming ingredients than necessary, not only because of their cost, but because of the effect of excess slag on the efficiency of the process. I therefore preferably minimize the overall amount of slag-forming materials in the pellets.

A general procedure for making two types of pellets may be observed as follows. First list the ingredients of the ore, coal, binder, calcitic lime, dolomite, bauxite, sand and/or other materials to be used in making the pellets, in percentages by weight. Preferably the major components will be in terms at least of $Fe_2O_3$, fixed carbon, $SiO_2$, $Al_2O_3$, CaO, and MgO. For the sake of simplicity in this explanation we will omit P, Mn, S, Ti and even MgO, which need not be employed where a high-carbon hot metal is desired. Then calculate the amounts of fluxing agents (slag-forming materials) that must be added to achieve a composite for the desired melt temperature in the SAF, for example a slag composition of 15% $Al_2O_3$, 32% CaO, and 53% $SiO_n$. The ratio of coal or other carbonaceous reductant to ore will be determined by techniques well known in the art of ore reduction, and will be influenced by the composition of the ore and the coal or other carbonaceous reductant. Generally the ratio will be maintained to achieve at least 90% reduction of the iron ore in the reducing zone.

Bearing in mind that 2–5% binder is desirable for each type of pellet, then allocate the binder as well as the fluxing and/or slag-forming agents to two types of pellets to achieve slag compositions within regions 31 and 32 of FIG. 2 and/or otherwise so they will not melt in the initial reducing zone or RHF. As may be seen from FIG. 2, one stream of pellets will be calcium poor and the other relatively calcium rich if regions 31 and 32 are used. It may be seen that the alumina contents of the two types of pellets are relatively low, ranging from an optimum low of 10% for the Region 32 composition to an optimum of 25% for the Region 31 composition. The silica content generally varies inversely with the CaO content—the CaO of Region 31 is from 0–10% while the CaO content of Region 32 can be from 50% to 60%.

The allocation of the slag-forming materials to the two types of pellets to satisfy the melting point condition will depend on the composition of the ore and the reductant. It is suggested that the weights of the two types can be varied by shifting amounts of ore and coal from one type of pellet to the other; this will have a noticeable effect on the silica and alumina contents of the pellets. Since the ratio of carbon to $Fe_2O_3$ is desirably held within a relatively narrow range, one will not shift significant amounts of ore or coal from one pellet type to the other without maintaining the ratio of coal and ore required for complete reduction of all iron oxides in the ore. Adjusting the slag composition of each type pellet by shifting coal and ore from one pellet type to the other will effectively minimize the use of additional slag-forming ingredients.

In the following computer-generated examples, runs 1–25, the iron ore was of either Composition A or Composition B below, in percents by weight, and the coal had composition C or D:

| | Ore | | Coal | |
|---|---|---|---|---|
| | A | B | C | D |
| Metallic Fe | 0.00 | 0.00 | 0.00 | 0.00 |
| FeO | 0.00 | 0.00 | 0.00 | 0.00 |
| $Fe_2O_3$ | 98.65 | 94.71 | 0.00 | 0.00 |
| Fixed Carbon | 0.00 | 0.00 | 74.07 | 85.25 |
| $SiO_2$ | 1.00 | 4.90 | 2.00 | 6.00 |
| $Al_2O_3$ | 0.17 | 0.33 | 1.27 | 3.00 |
| CaO | 0.01 | 0.01 | 0.13 | 0.13 |
| MgO | 0.01 | 0.01 | 0.05 | 0.05 |

-continued

| | Ore | | Coal | |
|---|---|---|---|---|
| | A | B | C | D |
| S | 0.00 | 0.00 | 0.72 | 0.63 |
| MnO | 0.02 | 0.02 | 0.00 | 0.00 |
| $P_2O_5$ | 0.05 | 0.02 | 0.01 | 0.00 |
| $TiO_2$ | 0.09 | 0.00 | 0.06 | 0.00 |
| Volatiles | 0.00 | 0.00 | 21.69 | 14.26 |

In each case, the binder, lime, dolomite, bauxite and sand had the following compositions in percents by weight:

| | Binder | Lime | Dolomite | Bauxite | Sand |
|---|---|---|---|---|---|
| Metallic Fe | 0.00 | 0.00 | 0.00 | 0.00 | 0.00 |
| FeO | 0.00 | 0.00 | 0.00 | 0.00 | 0.00 |
| $Fe_2O_3$ | 4.53 | 0.00 | 0.00 | 0.00 | 0.00 |
| Fixed Carbon | 0.00 | 0.00 | 0.00 | 0.00 | 0.00 |
| $SiO_2$ | 58.30 | 1.00 | 1.00 | 6.00 | 100.00 |
| $Al_2O_3$ | 19.74 | 1.00 | 1.00 | 83.00 | 0.00 |
| CaO | 1.25 | 96.50 | 59.00 | 0.00 | 0.00 |
| MgO | 1.73 | 1.50 | 39.00 | 0.00 | 0.00 |
| S | 0.19 | 0.00 | 0.00 | 0.00 | 0.00 |
| MnO | 0.00 | 0.00 | 0.00 | 0.50 | 0.00 |
| $P_2O_5$ | 0.00 | 0.00 | 0.00 | 0.50 | 0.00 |
| $TiO_2$ | 0.00 | 0.00 | 0.00 | 0.20 | 0.00 |
| Volatiles | 14.26 | 0.00 | 0.00 | 0.00 | 0.00 |

In each case, the objective was to design two pellet streams having the overall $Al_2O_3/CaO/SiO_2$ ratio indicated but wherein stream 1 is calcium-poor and stream 2 is calcium-rich such that the slag-forming components of stream 1 are in Region 31 and those of stream 2 are in Region 32 of FIG. 2. A further constraint was to make hot metal having the composition 95% Fe, 4.5% C, and 0.5% Si, except where otherwise stated. The practitioner will recognize also that the desired reduction effects require a close relation between the amount of $Fe_2O_3$ to be reduced in a pellet and the amount of carbon available to reduce it. This ratio was determined according to known principles. Compositions for runs 1–20 are shown in Table I.

TABLE I

| Run | Ore | Coal | % Binder | Aim % CaO in Stream 2 | Aim Overall $Al_2O_3/CaO/SiO_2$ |
|---|---|---|---|---|---|
| 1 | A | C | 3 | 55 | 18/32/50 |
| 2 | A | C | 4 | 55 | 18/32/50 |
| 3 | A | D | 3 | 55 | 18/32/50 |
| 4 | A | D | 4 | 55 | 18/32/50 |
| 5 | B | C | 3 | 55 | 18/32/50 |
| 6 | B | C | 4 | 55 | 18/32/50 |
| 7 | B | D | 3 | 55 | 18/32/50 |
| 8 | B | D | 4 | 55 | 18/32/50 |
| 9 | B | D | 4 | 60 | 18/32/50 |
| 10 | B | D | 4 | 60 | 18/32/50 |
| 11 | A | D | 4 | 60 | 18/32/50 |
| 12 | A | D | 4 | 60 | 18/32/50 |
| 13 | A | D | 4 | 60 | 15/30/55 |
| 14 | A | D | 4 | 60 | 20/35/45 |
| 15 | A | D | 4 | 60 | 20/35/45 |
| 16 | A | D | 4 | 55 | 20/35/45 |
| 17 | A | D | 4 | 50 | 20/35/45 |
| 18 | A | D | 4 | 60 | 18/32/50 |
| 19 | A | D | 4 | 55 | 18/32/50 |
| 20 | A | D | 4 | 50 | 18/32/50 |

The data on Runs 1 through 20 show the materials to be pelletized in each stream for each run, the weight ratio of the feed of the streams to form the mixture of pellets, and the percentage in each stream of the slag components $Al_2O_3$, CaO, and $SiO_2$. Weights are in metric tonnes.

| | Pelletizer streams | | | |
|---|---|---|---|---|
| | Pelletizer One | | Pelletizer Two | |
| | Tonnes | Percent | Tonnes | Percent |
| Run 1 | | | | |
| Ore | 0.826 | 71.16 | 0.550 | 67.70 |
| Coal | 0.2817 | 24.28 | 0.1988 | 24.45 |
| Binder | 0.034 | 2.91 | 0.024 | 2.91 |
| Lime | 0.000 | 0.00 | 0.040 | 4.94 |
| Dolomite | 0.000 | 0.00 | 0.000 | 0.00 |
| Bauxite | 0.003 | 0.26 | 0.000 | 0.00 |
| Sand | 0.016 | 1.39 | 0.000 | 0.00 |
| Total | 1.160 | 100.00 | 0.813 | 100.00 |
| Feed Ratio: 1.160:0.813 | | | | |
| Major Slag Components, % | | | | |
| $Al_2O_3$ | 20.33 | | 11.34 | |
| CaO | 1.26 | | 52.32 | |
| $SiO_2$ | 71.92 | | 31.47 | |
| Run 2 | | | | |
| Ore | 0.825 | 70.34 | 0.550 | 66.35 |
| Coal | 0.2817 | 24.01 | 0.1988 | 23.97 |
| Binder | 0.045 | 3.85 | 0.032 | 3.85 |
| Lime | 0.000 | 0.00 | 0.048 | 5.84 |
| Dolomite | 0.000 | 0.00 | 0.000 | 0.00 |
| Bauxite | 0.004 | 0.32 | 0.000 | 0.00 |
| Sand | 0.017 | 1.48 | 0.000 | 0.00 |
| Total | 1.173 | 100.00 | 0.829 | 100.00 |
| Feed Ratio: 1.173/0.829 | | | | |
| Major Slag Components, % | | | | |
| $Al_2O_3$ | 21.10 | | 11.36 | |
| CaO | 1.26 | | 52.59 | |
| $SiO_2$ | 71.75 | | 31.67 | |
| Run 3 | | | | |
| Ore | 0.826 | 73.44 | 0.551 | 68.99 |
| Coal | 0.2448 | 21.76 | 0.1727 | 21.64 |
| Binder | 0.033 | 2.91 | 0.023 | 2.91 |
| Lime | 0.000 | 0.00 | 0.052 | 6.46 |
| Dolomite | 0.000 | 0.00 | 0.000 | 0.00 |
| Bauxite | 0.003 | 0.25 | 0.000 | 0.00 |
| Sand | 0.018 | 1.64 | 0.000 | 0.00 |
| Total | 1.125 | 100.00 | 0.798 | 100.00 |
| Feed Ratio: 1.125:0.798 | | | | |
| Major Slag Components, % | | | | |
| $Al_2O_3$ | 21.07 | | 11.80 | |
| CaO | 0.97 | | 52.88 | |
| $SiO_2$ | 72.86 | | 31.47. | |
| Run 4 | | | | |
| Ore | 0.826 | 72.59 | 0.551 | 67.62 |
| Coal | 0.245 | 21.52 | 0.173 | 21.21 |
| Binder | 0.044 | 3.85 | 0.031 | 3.85 |
| Lime | 0.000 | 0.00 | 0.060 | 7.32 |
| Dolomite | 0.000 | 0.00 | 0.000 | 0.00 |
| Bauxite | 0.004 | 0.32 | 0.000 | 0.00 |
| Sand | 0.020 | 1.73 | 0.000 | 0.00 |
| Total | 1.138 | 100.00 | 0.814 | 100.00 |
| Feed Ratio: 1.138:0.814 | | | | |
| Major Slag Components, % | | | | |
| $Al_2O_3$ | 21.63 | | 11.75 | |
| CaO | 1.01 | | 53.03 | |
| $SiO_2$ | 72.61 | | 31.64 | |
| Run 5 | | | | |
| Ore | 0.860 | 71.53 | 0.573 | 65.92 |
| Coal | 0.2820 | 23.45 | 0.1986 | 22.84 |
| Binder | 0.035 | 2.91 | 0.025 | 2.91 |
| Lime | 0.000 | 0.00 | 0.072 | 8.33 |
| Dolomite | 0.000 | 0.00 | 0.000 | 0.00 |

-continued

| | Pelletizer streams | | | |
|---|---|---|---|---|
| | Pelletizer One | | Pelletizer Two | |
| | Tonnes | Percent | Tonnes | Percent |
| Bauxite | 0.020 | 1.67 | 0.000 | 0.00 |
| Sand | 0.005 | 0.44 | 0.000 | 0.00 |
| Total | 1.203 | 100.00 | 0.870 | 100.00 |
| Feed Ratio: 1.203:0.870 | | | | |
| Major Slag Components, % | | | | |
| $Al_2O_3$ | 27.37 | | 7.70 | |
| CaO | 0.81 | | 53.53 | |
| $SiO_2$ | 68.10 | | 36.10 | |
| Run 6 | | | | |
| Ore | 0.860 | 70.68 | 0.573 | 64.61 |
| Coal | 0.2820 | 23.18 | 0.1987 | 22.39 |
| Binder | 0.047 | 3.85 | 0.034 | 3.85 |
| Lime | 0.000 | 0.00 | 0.081 | 9.15 |
| Dolomite | 0.000 | 0.00 | 0.000 | 0.00 |
| Bauxite | 0.021 | 1.73 | 0.000 | 0.00 |
| Sand | 0.007 | 0.56 | 0.000 | 0.00 |
| Total | 1.217 | 100.00 | 0.887 | 100.00 |
| Feed Ratio: 1.217:0.887 | | | | |
| Major Slag Components, % | | | | |
| $Al_2O_3$ | 27.23 | | 8.10 | |
| CaO | 0.85 | | 53.57 | |
| $SiO_2$ | 68.36 | | 35.73 | |
| Run 7 | | | | |
| Ore | 0.861 | 73.73 | 0.574 | 67.10 |
| Coal | 0.2450 | 20.99 | 0.1726 | 20.19 |
| Binder | 0.034 | 2.91 | 0.025 | 2.91 |
| Lime | 0.000 | 0.00 | 0.084 | 9.80 |
| Dolomite | 0.000 | 0.00 | 0.000 | 0.00 |
| Bauxite | 0.020 | 1.71 | 0.000 | 0.00 |
| Sand | 0.008 | 0.65 | 0.000 | 0.00 |
| Total | 1.167 | 100.00 | 0.855 | 100.00 |
| Feed Ratio: 1.167:0.855 | | | | |
| Major Slag Components, % | | | | |
| $Al_2O_3$ | 27.08 | | 8.46 | |
| CaO | 0.67 | | 53.72 | |
| $SiO_2$ | 69.16 | | 35.50 | |
| Run 8 | | | | |
| Ore | 0.860 | 72.85 | 0.574 | 65.76 |
| Coal | 0.2451 | 20.75 | 0.1726 | 19.79 |
| Binder | 0.045 | 3.85 | 0.034 | 3.85 |
| Lime | 0.000 | 0.00 | 0.092 | 10.60 |
| Dolomite | 0.000 | 0.00 | 0.000 | 0.00 |
| Bauxite | 0.021 | 1.77 | 0.000 | 0.00 |
| Sand | 0.009 | 0.78 | 0.000 | 0.00 |
| Total | 1.181 | 100.00 | 0.872 | 100.00 |
| Feed Ratio: 1.181:0.872 | | | | |
| Major slag Components, % | | | | |
| $Al_2O_3$ | 26.98 | | 8.74 | |
| CaO | 0.72 | | 53.74 | |
| $SiO_2$ | 69.30 | | 35.23 | |
| Run 9 | | | | |
| Ore | 0.860 | 70.00 | 0.573 | 64.0 |
| Coal | 0.2453 | 19.96 | 0.1725 | 19.26 |
| Binder | 0.047 | 3.85 | 0.034 | 3.85 |
| Lime | 0.000 | 0.00 | 0.115 | 12.88 |
| Dolomite | 0.000 | 0.00 | 0.000 | 0.00 |
| Bauxite | 0.035 | 2.85 | 0.000 | 0.00 |
| Sand | 0.041 | 3.35 | 0.000 | 0.00 |
| Total | 1.229 | 100.00 | 0.896 | 100.00 |
| Feed Ratio: 1.229:0.896 | | | | |
| Major Slag Components, % | | | | |
| $Al_2O_3$ | 26.73 | | 7.87 | |
| CaO | 0.55 | | 58.69 | |
| $SiO_2$ | 70.24 | | 31.26 | |

-continued

| | Pelletizer streams | | | |
|---|---|---|---|---|
| | Pelletizer One | | Pelletizer Two | |
| | Tonnes | Percent | Tonnes | Percent |
| Run 10 | | | | |
| Ore | 0.789 | 67.72 | 0.645 | 64.30 |
| Coal | 0.2274 | 19.53 | 0.1905 | 18.98 |
| Binder | 0.045 | 3.85 | 0.039 | 3.85 |
| Lime | 0.000 | 0.00 | 0.129 | 12.87 |
| Dolomite | 0.000 | 0.00 | 0.000 | 0.00 |
| Bauxite | 0.043 | 3.73 | 0.000 | 0.00 |
| Sand | 0.060 | 5.17 | 0.000 | 0.00 |
| Total | 1.164 | 100.00 | 1.003 | 100.00 |
| Feed Ratio: 1.164:1.003 | | | | |
| Major Slag Components, % | | | | |
| $Al_2O_3$ | 27.01 | | 7.84 | |
| CaO | 0.46 | | 58.69 | |
| $SiO_2$ | 70.26 | | 31.29 | |
| Run 11 | | | | |
| Ore | 0.826 | 70.65 | 0.551 | 66.36 |
| Coal | 0.245 | 20.96 | 0.173 | 20.81 |
| Binder | 0.045 | 3.85 | 0.032 | 3.85 |
| Lime | 0.000 | 0.00 | 0.074 | 8.98 |
| Dolomite | 0.000 | 0.00 | 0.000 | 0.00 |
| Bauxite | 0.013 | 1.09 | 0.000 | 0.00 |
| Sand | 0.040 | 3.46 | 0.000 | 0.00 |
| Total | 1.169 | 100.00 | 0.830 | 100.00 |
| Feed Ratio: 1.169:0.830 | | | | |
| Major Slag Components, % | | | | |
| $Al_2O_3$ | 22.68 | | 10.52 | |
| CaO | 0.00 | | 58.00 | |
| $SiO_2$ | 72.70 | | 28.15 | |
| Run 12 | | | | |
| Ore | 0.757 | 69.03 | 0.619 | 66.69 |
| Coal | 0.227 | 20.70 | 0.191 | 20.53 |
| Binder | 0.042 | 3.85 | 0.036 | 3.85 |
| Lime | 0.000 | 0.00 | 0.083 | 8.94 |
| Dolomite | 0.000 | 0.00 | 0.000 | 0.00 |
| Bauxite | 0.018 | 1.64 | 0.000 | 0.00 |
| Sand | 0.052 | 4.78 | 0.000 | 0.00 |
| Total | 1.097 | 100.00 | 0.929 | 100.00 |
| Feed Ratio: 1.097:0.929 | | | | |
| Major Slag Components, % | | | | |
| $Al_2O_3$ | 23.04 | | 10.50 | |
| CaO | 0.66 | | 58.00 | |
| $SiO_2$ | 72.91 | | 28.16 | |
| Run 13 | | | | |
| Ore | 0.757 | 68.02 | 0.620 | 66.69 |
| Coal | 0.227 | 20.38 | 0.191 | 20.52 |
| Binder | 0.043 | 3.85 | 0.036 | 3.85 |
| Lime | 0.000 | 0.00 | 0.083 | 8.94 |
| Dolomite | 0.000 | 0.00 | 0.000 | 0.00 |
| Bauxite | 0.012 | 1.05 | 0.000 | 0.00 |
| Sand | 0.075 | 6.70 | 0.000 | 0.00 |
| Total | 1.114 | 100.00 | 0.929 | 100.00 |
| Feed Ratio: 1.114:0.929 | | | | |
| Major Slag Components, % | | | | |
| $Al_2O_3$ | 17.16 | | 10.50 | |
| CaO | 0.59 | | 58.00 | |
| $SiO_2$ | 79.35 | | 28.16 | |
| Run 14 | | | | |
| Ore | 0.757 | 70.44 | 0.619 | 66.68 |
| Coal | 0.227 | 21.13 | 0.191 | 20.53 |
| Binder | 0.041 | 3.85 | 0.036 | 3.85 |
| Lime | 0.000 | 0.00 | 0.083 | 8.94 |
| Dolomite | 0.000 | 0.00 | 0.000 | 0.00 |

-continued

| | Pelletizer streams | | | |
|---|---|---|---|---|
| | Pelletizer One | | Pelletizer Two | |
| | Tonnes | Percent | Tonnes | Percent |
| Bauxite | 0.019 | 1.78 | 0.000 | 0.00 |
| Sand | 0.030 | 2.81 | 0.000 | 0.00 |
| Total | 1.074 | 100.00 | 0.929 | 100.00 |
| | Feed Ratio: 1.074:0.929 | | | |
| | Major Slag Components, % | | | |
| $Al_2O_3$ | 28.10 | | 10.50 | |
| CaO | 0.78 | | 58.00 | |
| $SiO_2$ | 67.07 | | 28.16 | |
| Run 15 | | | | |
| Ore | 0.971 | 74.33 | 0.405 | 65.34 |
| Coal | 0.283 | 21.65 | 0.135 | 21.72 |
| Binder | 0.050 | 3.85 | 0.024 | 3.85 |
| Lime | 0.000 | 0.00 | 0.056 | 9.09 |
| Dolomite | 0.000 | 0.00 | 0.000 | 0.00 |
| Bauxite | 0.000 | 0.18 | 0.000 | 0.00 |
| Sand | 0.000 | 0.00 | 0.000 | 0.00 |
| Total | 1.306 | 100.00 | 0.620 | 100.00 |
| | Feed Ratio: 1.306:0.620 | | | |
| | Major Slag Components, % | | | |
| $Al_2O_3$ | 26.09 | | 10.56 | |
| CaO | 1.30 | | 57.99 | |
| $SiO_2$ | 66.52 | | 28.10 | |
| Run 16 | | | | |
| Ore | 0.858 | 74.08 | 0.518 | 67.44 |
| Coal | 0.253 | 21.87 | 0.164 | 21.38 |
| Binder | 0.045 | 3.85 | 0.030 | 3.85 |
| Lime | 0.000 | 0.00 | 0.056 | 7.34 |
| Dolomite | 0.000 | 0.20 | 0.000 | 0.00 |
| Bauxite | 0.002 | 0.00 | 0.000 | 0.00 |
| Sand | 0.000 | 0.00 | 0.000 | 0.00 |
| Total | 1.158 | 100.00 | 0.768 | 100.00 |
| | Feed Ratio: 1.158:0.768 | | | |
| | Major Slag Components, % | | | |
| $Al_2O_3$ | 26.32 | | 11.76 | |
| CaO | 1.29 | | 53.03 | |
| $SiO_2$ | 66.30 | | 31.63 | |
| Run 17 | | | | |
| Ore | 0.722 | 73.70 | 0.654 | 69.09 |
| Coal | 0.218 | 22.22 | 0.200 | 21.11 |
| Binder | 0.038 | 3.85 | 0.036 | 3.85 |
| Lime | 0.000 | 0.00 | 0.056 | 5.95 |
| Dolomite | 0.000 | 0.00 | 0.000 | 0.00 |
| Bauxite | 0.000 | 0.24 | 0.000 | 0.00 |
| Sand | 0.000 | 0.00 | 0.000 | 0.00 |
| Total | 0.980 | 100.00 | 0.947 | 100.00 |
| | Feed Ratio 0.980:0.947 | | | |
| | Major Slag Components, % | | | |
| $Al_2O_3$ | 26.68 | | 12.95 | |
| CaO | 1.29 | | 48.08 | |
| $SiO_2$ | 70.22 | | 35.14 | |
| Run 18 | | | | |
| Ore | 1.073 | 74.32 | 0.304 | 61.95 |
| Coal | 0.309 | 21.43 | 0.108 | 22.06 |
| Binder | 0.056 | 3.85 | 0.019 | 3.85 |
| Lime | 0.000 | 0.00 | 0.054 | 10.96 |
| Dolomite | 0.000 | 0.00 | 0.000 | 0.00 |
| Bauxite | 0.000 | 0.00 | 0.000 | 0.00 |
| Sand | 0.006 | 0.40 | 0.006 | 1.18 |
| Total | 1.443 | 100.00 | 0.490 | 100.00 |
| | Feed Ratio: 1.443:0.490 | | | |
| | Major Slag Components, % | | | |
| $Al_2O_3$ | 22.92 | | 8.94 | |
| CaO | 1.25 | | 58.24 | |
| $SiO_2$ | 70.04 | | 29.89 | |

-continued

| | Pelletizer streams | | | |
|---|---|---|---|---|
| | Pelletizer One | | Pelletizer Two | |
| | Tonnes | Percent | Tonnes | Percent |
| Run 19 | | | | |
| Ore | 0.972 | 74.16 | 0.404 | 64.91 |
| Coal | 0.283 | 21.59 | 0.134 | 21.59 |
| Binder | 0.050 | 3.85 | 0.024 | 3.85 |
| Lime | 0.000 | 0.00 | 0.054 | 8.64 |
| Dolomite | 0.000 | 0.00 | 0.000 | 0.00 |
| Bauxite | 0.000 | 0.00 | 0.000 | 0.00 |
| Sand | 0.005 | 0.40 | 0.006 | 1.01 |
| Total | 1.311 | 100.00 | 0.622 | 100.00 |
| | Feed Ratio: 1.311:0.622 | | | |
| | Major Slag Components, % | | | |
| $Al_2O_3$ | 22.93 | | 10.15 | |
| CaO | 1.25 | | 53.25 | |
| $SiO_2$ | 70.02 | | 33.42 | |
| Run 20 | | | | |
| Ore | 0.847 | 73.89 | 0.529 | 67.25 |
| Coal | 0.250 | 21.83 | 0.167 | 21.24 |
| Binder | 0.044 | 3.85 | 0.030 | 3.85 |
| Lime | 0.000 | 0.00 | 0.054 | 6.83 |
| Dolomite | 0.000 | 0.00 | 0.000 | 0.00 |
| Bauxite | 0.000 | 0.00 | 0.000 | 0.00 |
| Sand | 0.005 | 0.43 | 0.007 | 0.84 |
| Total | 1.146 | 100.00 | 0.787 | 100.00 |
| | Feed Ratio: 1.146:0.787 | | | |
| | Major Slag Components, % | | | |
| $Al_2O_3$ | 22.85 | | 11.43 | |
| CaO | 1.24 | | 48.28 | |
| $SiO_2$ | 70.12 | | 36.85 | |

Run 21 was somewhat different in that it aimed for a MgO content in the final slag of five percent; the target $SiO_2$ was 50 percent. In the hot metal, the target carbon content was 4.5%. In pellet stream One, no lime or dolomite was added; only bauxite and sand. Sufficient coal was used to reduce all the iron oxides in pellet stream One and in addition alloy the hot metal to 4.5% carbon while at the same time reducing sufficient $SiO_2$ to obtain the desired silicon content of the hot metal of 0.5%. In pellet stream Two, no bauxite or sand was used—only lime and/or dolomite. Coal usage was sufficient only to perform complete reduction of all the iron oxides.

| | Pelletizer streams | | | |
|---|---|---|---|---|
| | Pelletizer One | | Pelletizer Two | |
| | Tonnes | Percent | Tonnes | Percent |
| Run 21 | | | | |
| Ore A | 0.710 | 70.77 | 0.666 | 71.05 |
| Coal D | 0.243 | 24.23 | 0.174 | 18.60 |
| Binder | 0.039 | 3.85 | 0.036 | 3.85 |
| Lime | 0.000 | 0.00 | 0.043 | 4.59 |
| Dolomite | 0.000 | 0.00 | 0.018 | 1.91 |
| Bauxite | 0.000 | 0.00 | 0.000 | 0.00 |
| Sand | 0.012 | 1.16 | 0.000 | 0.00 |
| Total | 1.004 | 100.00 | 0.938 | 100.00 |
| | Feed Ratio: 1.004:0.938 | | | |
| | Major Slag Components, % | | | |
| $Al_2O_3$ | 20.96 | | 12.00 | |
| CaO | 1.13 | | 45.29 | |
| $SiO_2$ | 72.63 | | 33.21 | |
| MgO | 1.12 | | 7.22 | |

-continued

| | Pelletizer streams | | | |
|---|---|---|---|---|
| | Pelletizer One | | Pelletizer Two | |
| | Tonnes | Percent | Tonnes | Percent |
| Run 22 | | | | |
| Ore A | 0.765 | 73.70 | 0.655 | 71.06 |
| Coal D | 0.222 | 21.41 | 0.171 | 18.60 |
| Binder | 0.040 | 3.85 | 0.035 | 3.85 |
| Lime | 0.000 | 0.00 | 0.042 | 4.59 |
| Dolomite | 0.000 | 0.00 | 0.018 | 1.91 |
| Bauxite | 0.000 | 0.00 | 0.000 | 0.00 |
| Sand | 0.011 | 1.04 | 0.000 | 0.00 |
| Total | 1.038 | 100.00 | 0.921 | 100.00 |
| | Feed Ratio: 1.038:0.921 | | | |
| | Major Slag Components, % | | | |
| $Al_2O_3$ | 20.91 | | 12.08 | |
| CaO | 1.14 | | 45.30 | |
| $SiO_2$ | 72.68 | | 33.22 | |
| MgO | 1.16 | | 7.19 | |
| Run 23 | | | | |
| Ore A | 0.823 | 73.33 | 0.597 | 71.29 |
| Coal D | 0.238 | 21.16 | 0.156 | 18.66 |
| Binder | 0.043 | 3.85 | 0.032 | 3.85 |
| Lime | 0.000 | 0.00 | 0.042 | 5.06 |
| Dolomite | 0.008 | 0.71 | 0.010 | 1.15 |
| Bauxite | 0.000 | 0.00 | 0.000 | 0.00 |
| Sand | 0.011 | 0.97 | 0.000 | 0.00 |
| Total | 1.123 | 100.00 | 0.837 | 100.00 |
| | Feed Ratio: 1.123:0.837 | | | |
| | Major Slag Components, % | | | |
| $Al_2O_3$ | 19.31 | | 12.35 | |
| CaO | 6.32 | | 46.37 | |
| $SiO_2$ | 66.05 | | 34.02 | |
| MgO | 4.55 | | 5.00 | |

In Run 24, the objective was 5.0% carbon in the hot metal, with a slag ratio in the SAF of $Al_2O_3/CaO/SiO_2$ of 15/32/53, wherein the CaO content of the slag-forming components in Pellet Stream 2 is at least 50%.

| | Pelletizer streams | | | |
|---|---|---|---|---|
| | Pelletizer One | | Pelletizer Two | |
| | Tonnes | Percent | Tonnes | Percent |
| Run 24 | | | | |
| Ore A | 0.746 | 69.02 | 0.624 | 70.32 |
| Coal D | 0.258 | 23.90 | 0.163 | 18.40 |
| Binder | 0.042 | 3.85 | 0.034 | 3.85 |
| Lime | 0.000 | 0.00 | 0.066 | 7.43 |
| Dolomite | 0.000 | 0.00 | 0.000 | 0.00 |
| Bauxite | 0.000 | 0.00 | 0.000 | 0.00 |
| Sand | 0.035 | 3.23 | 0.000 | 0.80 |
| Total | 1.081 | 100.00 | 0.887 | 100.00 |
| | Feed Ratio: 1.081:0.887 | | | |
| | Major Slag Components, % | | | |
| $Al_2O_3$ | 16.46 | | 11.28 | |
| CaO | 0.89 | | 54.33 | |
| $SiO_2$ | 78.52 | | 30.91 | |
| MgO | 0.88 | | 1.46 | |

In Run 25, the objective was to make a hot metal with 1.5% carbon, slag ratios $Al_2O_3/CaO/SiO_2$ of 15/32/53, a CaO content in Pellet Stream Two of greater than 50%, and MgO in the SAF slag of 5%.

| | Pelletizer streams | | | |
|---|---|---|---|---|
| | Pelletizer One | | Pelletizer Two | |
| | Tonnes | Percent | Tonnes | Percent |
| Run 24 | | | | |
| Ore A | 0.803 | 72.24 | 0.617 | 69.63 |
| Coal D | 0.232 | 20.88 | 0.161 | 18.23 |
| Binder | 0.043 | 3.85 | 0.034 | 3.85 |
| Lime | 0.000 | 0.00 | 0.051 | 5.81 |
| Dolomite | 0.000 | 0.00 | 0.022 | 2.49 |
| Bauxite | 0.000 | 0.00 | 0.000 | 0.00 |
| Sand | 0.034 | 3.04 | 0.000 | 0.00 |
| Total | 1.112 | 100.00 | 0.886 | 100.00 |
| | Feed Ratio: 1.112:0.886 | | | |
| | Slag Components, % | | | |
| $Al_2O_3$ | 16.35 | | 10.63 | |
| CaO | 0.89 | | 50.42 | |
| $SiO_2$ | 78.65 | | 29.01 | |
| MgO | 0.91 | | 8.04 | |

It may be observed that, in the above computer-generated Runs 1 through 25, no lime is added to the composition for Pelletizer One, as this composition is meant to fall within the calcium-poor Region 31 of FIG. 2, while lime and dolomite in various amounts from 4.84% to 12.88% are added to Pelletizer Two, destined to satisfy Region 32. It will also be noted that, where bauxite is used, it is used in Pelletizer One. Also, sand is used primarily in Pelletizer One, although it need not be used at all in some instances and can be used in both. Generally, bauxite and sand are used only in Pellet Stream One, and dolomite and lime are used only in Pellet Stream Two (except Run 23, which uses dolomite in Stream One). These two general guidelines serve to achieve the calcium poor region 31 and the calcium rich region 32 in FIG. 2. Columns of percentages shown to have a total of 100% may not appear to have that precise total because of the cutoff at the second decimal place.

I claim:

1. Method of making hot metal comprising (a) preparing a plurality of portions of green pellets for reducing, in a heated reducing zone, to sponge iron pellets, said green pellets of each of said portions comprising (i) iron ore, (ii) carbon-containing reductant, and (iii) slag-forming materials, said slag-forming materials together with slag-forming materials in said iron ore and said carbon-containing reductant making up a slag-forming composition in each of said portions of green pellets having a melting point higher than the temperature of said heated reducing zone, each of said slag-forming compositions of said portions of green pellets being different from the others, but wherein the total composition of slag-forming materials of all of said portions of green pellets has a melting point lower than said temperature of said heated reducing zone, (b) reducing said green pellets in said heated reducing zone to form sponge iron pellets, and (c) feeding said sponge iron pellets to a smelting zone having a temperature lower than said temperature of said heated reducing zone, to further reduce said sponge iron pellets, form a molten slag, and form hot metal for removal from said smelting zone.

2. Method of claim 1 wherein said portions of green pellets are fed to said heated reducing zone continuously.

3. Method of claim 1 wherein said hot metal contains 1% to 5% carbon.

4. Method of claim 1 wherein said total composition of slag-forming agents comprises a combination of $Al_2O_3$, CaO, and $SiO_2$ having a melting point no higher than 1375° C.

5. Method of claim 1 wherein each of said plurality of portions of green pellets includes slag-forming agents having a melting point of at least 1550° C.

6. Method of claim 1 wherein said heated reducing zone is a rotary hearth furnace.

7. Method of claim 1 wherein said smelting zone is a submerged arc furnace.

8. Method of claim 1 wherein the difference in temperature between said heated reducing zone and said smelting zone is at least 100° C.

9. Method of claim 1 wherein said hot metal contains up to 5% carbon by weight and said slag-forming agents include from 1% to 8% magnesium oxide.

10. A mixture of green iron ore pellets comprising green iron ore pellets of at least two different compositions, each of said compositions including iron ore, carbonaceous reductant, binder, and added slag-forming components in ratios and quantities to have a slag melting temperature of at least 100° C. higher than the slag melting point of said mixture.

11. A mixture of green iron ore pellets of claim 10 comprising pellets of two different compositions, wherein the total slag-forming components of one of said compositions comprises no more than 10% CaO and the total slag-forming components of the other of said compositions comprise 50–60% CaO.

12. A mixture of green iron ore pellets of claim 10 comprising pellets of two different compositions, wherein the total slag-forming components of one of said compositions is a composition within Region 31 of FIG. 2 and the total slag-forming components of the other of said compositions is a composition within Region 32 of FIG. 2.

13. Sponge iron comprising a mixture of reduced iron ore pellets of at least two different compositions, each of said compositions including slag-forming components in ratios and quantities to have a melting temperature of at least 1550° C., the total of all such compositions including total slag-forming components in ratios and quantities having a melting point lower than 1400° C.

14. Sponge iron of claim 13 comprising pellets of two different compositions, wherein the total slag-forming components of one of said compositions comprises no more than 10% CaO and the total slag-forming components of the other of said compositions comprises at least 50% CaO.

15. Sponge iron of claim 13 comprising pellets of two different compositions, wherein the total slag-forming components of one of said compositions is a composition within Region 31 of FIG. 2 and the other of said compositions is a composition within Region 32 of FIG. 2.

16. Method of making iron ore pellets for reduction in a relatively high temperature range to sponge iron pellets and subsequent conversion in a relatively low temperature range to hot metal comprising (1) forming two compositions (a) and (b), each including independently selected major amounts of iron ore and coal, independently selected minor amounts of binder, and independently selected optional amounts, if any of lime, dolomite, bauxite, and sand, the slag-forming ingredients of each of said compositions (a) and (b) having composite melting temperatures higher than 1550° C., while the slag-forming ingredients of compositions (a) and (b) together have a melting temperature no higher than 1400° C. and (2) pelletizing said compositions (a) and (b) into pellets of said separate compositions (a) and (b).

17. Method of claim 16 wherein composition (a) is calcium-rich and composition (b) is calcium-poor.

18. Method of claim 16 wherein said optional amounts of lime, dolomite, bauxite and sand are no greater than necessary to form a slag in a submerged arc furnace at 1375° C.

* * * * *